US008770998B2

(12) United States Patent
Boncelet

(10) Patent No.: US 8,770,998 B2
(45) Date of Patent: Jul. 8, 2014

(54) SAFETY CONNECTION ELECTRICAL SYSTEMS AND METHODS

(75) Inventor: Charles Boncelet, Newark, DE (US)

(73) Assignee: University of Delaware, Newark, DE (US)

( * ) Notice: Subject to any disclaimer, the term of this patent is extended or adjusted under 35 U.S.C. 154(b) by 520 days.

(21) Appl. No.: 13/008,369

(22) Filed: Jan. 18, 2011

(65) Prior Publication Data

US 2011/0177706 A1 Jul. 21, 2011

Related U.S. Application Data

(60) Provisional application No. 61/295,853, filed on Jan. 18, 2010.

(51) Int. Cl.
*H01R 13/703* (2006.01)

(52) U.S. Cl.
USPC ..... 439/188

(58) Field of Classification Search
USPC ..... 439/188, 489, 955; 200/51.09
See application file for complete search history.

(56) References Cited

U.S. PATENT DOCUMENTS

| | | | | |
|---|---|---|---|---|
| 3,942,856 | A * | 3/1976 | Mindheim et al. | 200/51.09 |
| 4,591,732 | A * | 5/1986 | Neuenschwander | 307/140 |
| 4,915,639 | A * | 4/1990 | Cohn et al. | 439/188 |
| 5,222,164 | A * | 6/1993 | Bass et al. | 385/14 |
| 5,256,076 | A * | 10/1993 | Hamlin | 439/188 |
| 5,297,015 | A * | 3/1994 | Miyazaki et al. | 363/146 |
| 5,542,425 | A * | 8/1996 | Marshall et al. | 600/437 |
| 6,049,143 | A * | 4/2000 | Simpson et al. | 307/126 |
| 6,061,261 | A * | 5/2000 | Chen et al. | 363/146 |
| 6,183,264 | B1 * | 2/2001 | Harsanyi | 439/38 |
| 6,428,334 | B1 * | 8/2002 | Skarie et al. | 439/188 |
| 6,552,888 | B2 * | 4/2003 | Weinberger | 361/57 |
| 7,041,918 | B1 * | 5/2006 | Wu | 200/51.09 |
| 7,654,857 | B2 * | 2/2010 | Morey et al. | 439/489 |
| 7,825,546 | B2 * | 11/2010 | Li et al. | 307/326 |
| 7,828,586 | B2 * | 11/2010 | Gorczyca et al. | 439/489 |
| 7,978,447 | B2 * | 7/2011 | Baxter | 361/42 |
| 8,004,267 | B2 * | 8/2011 | Chen et al. | 323/346 |
| 8,008,586 | B2 * | 8/2011 | Kuehl et al. | 200/51 R |
| 8,472,152 | B2 * | 6/2013 | Ford et al. | 361/2 |
| 2007/0149013 | A1 * | 6/2007 | Eastham et al. | 439/140 |
| 2008/0233780 | A1 | 9/2008 | Waters | |
| 2008/0274638 | A1 | 11/2008 | Chen | |
| 2009/0110404 | A1 | 4/2009 | Agevik | |

OTHER PUBLICATIONS

International Search Report issued in PCT/US2011/021502 filed on Jan. 18, 2011, mailed on Sep. 27, 2011.
Written Opinion issued in PCT/US2011/021502 filed on Jan. 18, 2011, mailed on Sep. 27, 2011.

* cited by examiner

*Primary Examiner* — Neil Abrams
(74) *Attorney, Agent, or Firm* — RatnerPrestia

(57) ABSTRACT

Electrical connection systems and methods are disclosed. An electrical system includes an electrical plug and an electrical receptacle. The electrical plug has at least one prong having at least one opening. The electrical receptacle has at least one socket, an electrical contact positioned within the at least one socket, a light source positioned to transmit light through the at least one socket, and a photodetector positioned to receive the light transmitted by the light source through the at least one socket. The electrical receptacle further has a microprocessor programmed to selectively couple the electrical contact with the power source based on the light received by the photodetector.

14 Claims, 6 Drawing Sheets

SAFETY CONNECTION ELECTRICAL SYSTEMS AND METHODS

CROSS REFERENCE TO RELATED APPLICATIONS

This application claims priority to U.S. patent application No. 61/295,853, entitled "SAFETY ELECTRICAL PLUG AND RECEPTACLE," filed on Jan. 18, 2010, the contents of which are incorporated herein by reference.

FIELD OF THE INVENTION

The present invention relates generally to electrical connection systems, and more particularly, to systems and methods for creating safe electrical connections.

BACKGROUND OF THE INVENTION

Electrical connection systems provide inhabitants of modern buildings with access to a dedicated power supply. Electrical appliances and devices generally include an electrical plug, which may be selectively coupled to an electrical receptacle incorporated into the structure of the building. Coupling and uncoupling the electrical plug with the electrical receptacle creates an electrical circuit from which the appliance or device may draw power.

Electrical connection systems may pose a danger to inhabitants in the form of electrical shock or arcing. Accordingly, safe electrical connection systems are desired.

SUMMARY OF THE INVENTION

The present invention is embodied in electrical connection systems and methods.

In accordance with one aspect of the present invention, an electrical receptacle system is disclosed. The electrical receptacle system comprises at least one socket, an electrical contact, a light source, a photodetector, and a microprocessor. The at least one socket is sized to receive a respective prong from an electrical plug. The electrical contact is positioned within the at least one socket. The electrical contact is selectively coupled with a power source. The light source is positioned to transmit light through the at least one socket. The photodetector is positioned to receive the light transmitted by the light source through the at least one socket. The microprocessor is programmed to selectively couple the electrical contact with the power source based on the light received by the photodetector.

In accordance with another aspect of the present invention, an electrical connection system is disclosed. The electrical connection system comprises an electrical plug and an electrical receptacle. The electrical plug has at least one prong. The at least one prong has at least one opening. The electrical receptacle has at least one socket sized to receive the at least one prong from the electrical plug. The electrical receptacle further has an electrical contact positioned within the at least one socket. The electrical contact is selectively coupled with a power source. The electrical receptacle further has a light source positioned to transmit light through the at least one socket. The electrical receptacle further has a photodetector positioned to receive the light transmitted by the light source through the at least one socket and through the at least one opening formed in the at least one prong of the electrical plug. The electrical receptacle further has a microprocessor programmed to selectively couple the electrical contact with the power source based on the light received by the photodetector.

In accordance with still another aspect of the present invention, an electrical connection method is disclosed. The electrical connection method comprises inserting an electrical plug into an electrical receptacle, the electrical plug having at least one prong, the at least one prong having at least one opening, the electrical receptacle having at least one socket sized to receive the at least one prong from the electrical plug, an electrical contact positioned within the at least one socket, a light source, and a photodetector. The electrical connection method also comprises transmitting light with the light source through the at least one socket. The electrical connection method also comprises receiving with the photodetector the light transmitted by the light source through the at least one socket and through the at least one opening formed in the at least one prong of the electrical plug. Finally, the electrical connection method comprises selectively coupling the electrical contact with a power source based on the light received by the photodetector.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. This emphasizes that according to common practice, the various features of the drawings are not drawn to scale unless otherwise indicated. On the contrary, the dimensions of the various features may be expanded or reduced for clarity. Included in the drawings are the following figures.

DETAILED DESCRIPTION OF THE INVENTION

The exemplary systems and methods disclosed herein are broadly usable for implementing electrical connections. The disclosed systems may be incorporated in any structures in which it is necessary or desirable to make electrical connections. In an exemplary embodiment, the systems and methods described herein may be usable with or in place of conventional two-prong (hot, neutral) or conventional three-prong (hot, neutral, ground) electrical plugs and receptacles. As set forth herein, the disclosed electrical connection systems and methods may be particularly suitable for preventing undesirable electrical arcs, and thereby providing safer electrical connections.

Figure 1:
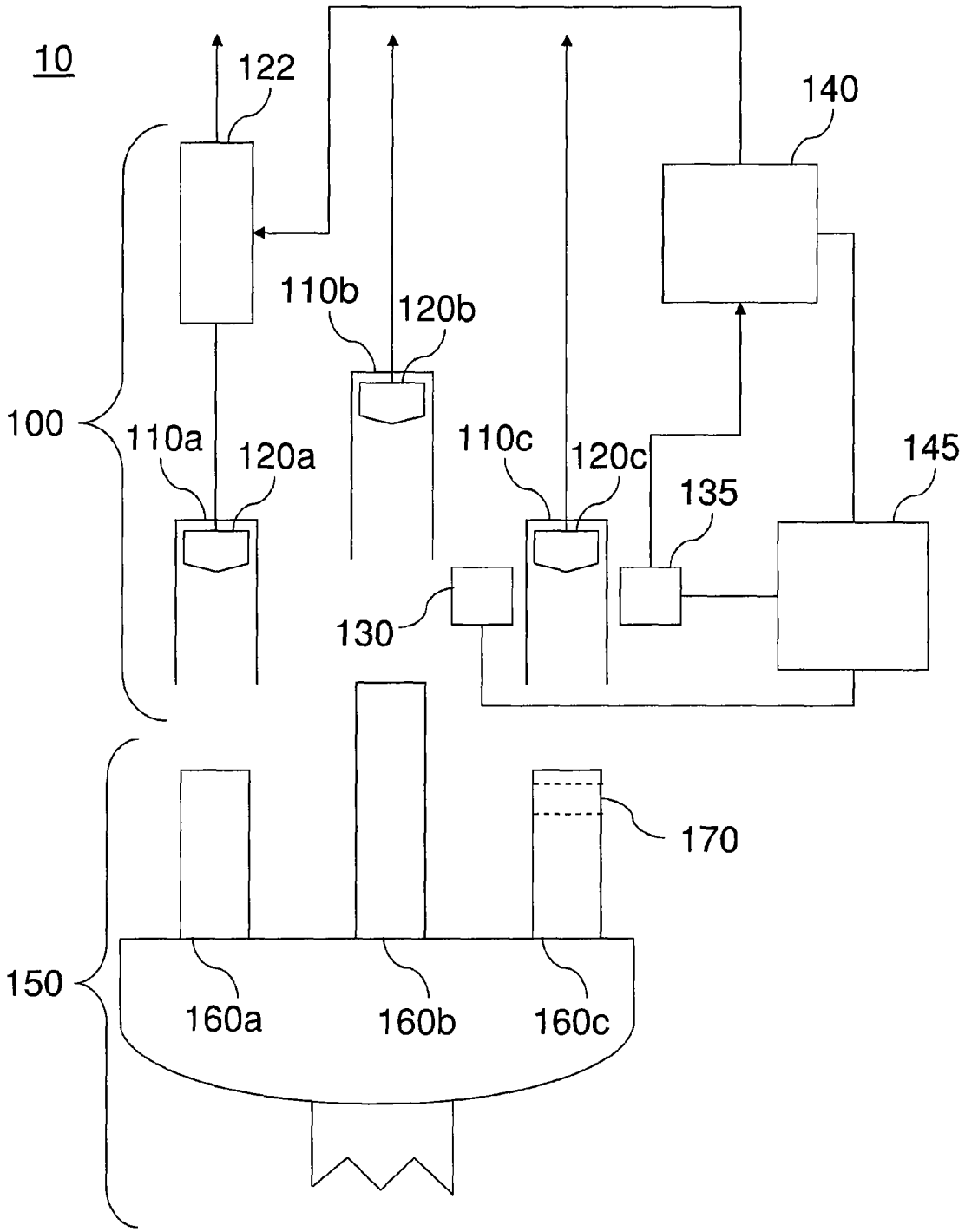
FIG. 1 is a block diagram illustrating an exemplary electrical connection system in accordance with aspects of the present invention.
Figure 2:
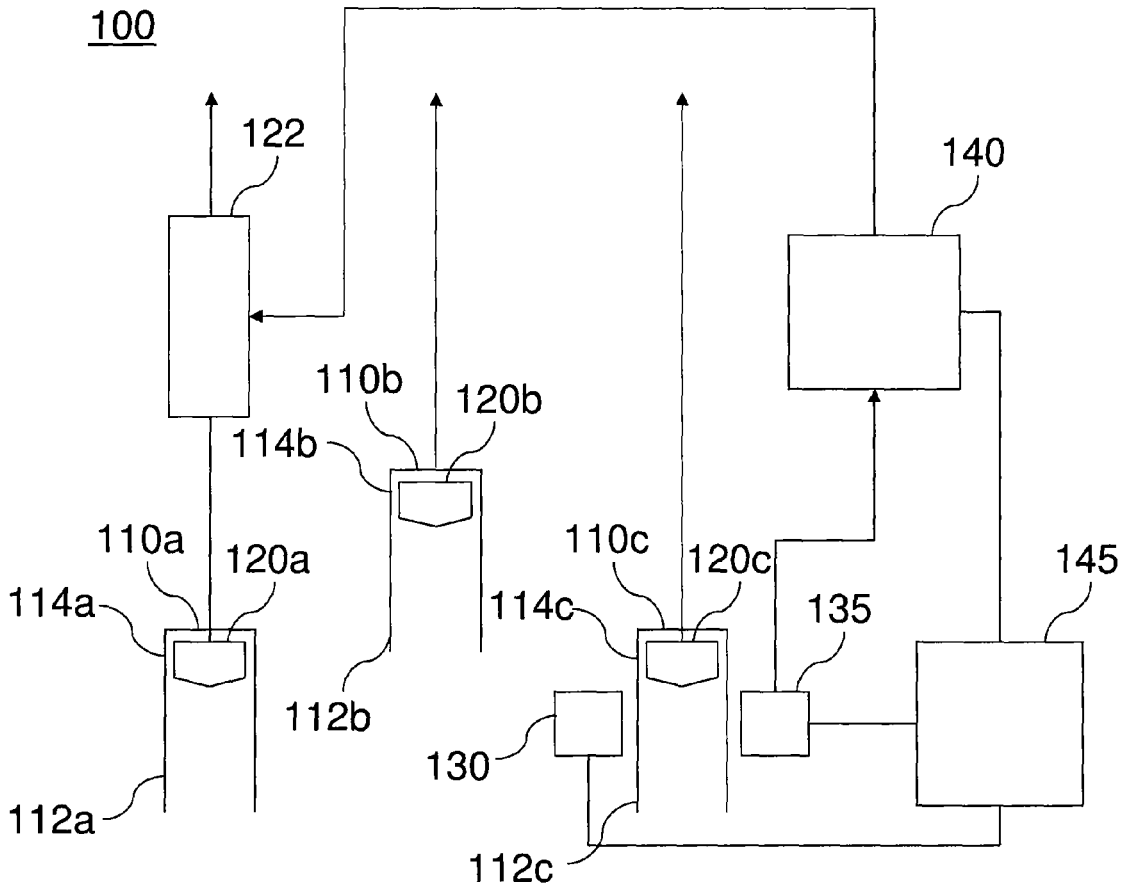
FIG. 2 is a block diagram illustrating an exemplary electrical receptacle system of the electrical connection system of FIG. 1.
Figure 3:
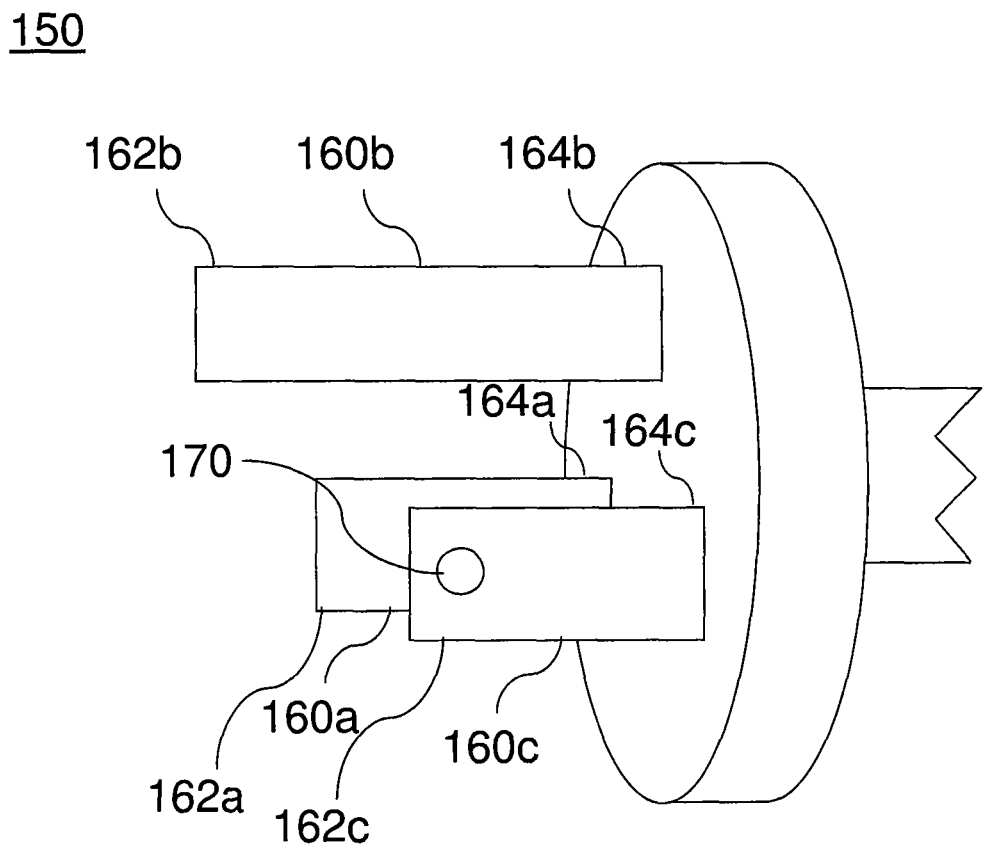
FIG. 3 is a perspective view illustrating an exemplary electrical plug system of the electrical connection system of FIG. 1.

Referring now to the drawings, FIGS. 1-3 illustrate an exemplary electrical connection system 10 in accordance with aspects of the present invention. Electrical connection system 10 may be usable to provide electrical connections between a power supply and an electrical appliance or device. Electrical connection system 10 includes an electrical receptacle system 100 and an electrical plug system 150. Additional details of electrical connection system 10 are provided herein.

FIG. 2 illustrates electrical receptacle system 100 in accordance with aspects of the present invention. Electrical receptacle system 100 may be incorporated in a wall or other structure in order to provide an electrical connection for an electrical appliance or device. Generally speaking, electrical receptacle system 100 includes sockets 110*a*, 110*b*, 110*c*, electrical contacts 120*a*, 120*b*, 120*c*, light source 130, photodetector 135, and microprocessor 140. Additional details of electrical receptacle system 100 are provided herein.

Sockets 110 receive corresponding portions of an electrical plug. Each socket 110 is sized to receive a respective prong 160 of the electrical plug system 150. As illustrated in FIG. 2, electrical receptacle system 100 may include three sockets 110. However, it will be understood by one of ordinary skill in the art that electrical receptacle system 100 may include more or fewer sockets 110 as is desired. In an exemplary embodiment, sockets 110 are selected and positioned to correspond to a conventional three-prong electrical plug. Suitable sockets 110 will be known to one of ordinary skill in the art from the description herein.

Electrical contacts 120 are positioned within sockets 110. Each contact 120 is positioned within a respective socket 110. Electrical contacts 120 may be positioned such that that each contact 120 will make contact with a respective prong 160 of electrical plug system 150 when the prongs 160 are approximately fully inserted into sockets 110. In an exemplary embodiment, contacts 120 are formed from a conductive metal such as, for example, copper. Suitable contacts 120 will be known to one of ordinary skill in the art from the description herein.

One or more electrical contacts 120 are selectively coupled with a power source (not shown). The power source may be, for example, a source of alternating current power. In the embodiment illustrated in FIG. 2, only one electrical contact 120 (contact 120*a*) is selectively coupled with the power source. However, it will be understood by one of ordinary skill in the art that one or more of contacts 120 may be selectively coupled to the power source. In an exemplary embodiment, electrical contacts 120 are selectively coupled with the power source via a relay 122. In the embodiment illustrated in FIG. 2, relay 122 is only connected with one electrical contact 120 (contact 120*a*). Relay 122 may desirably be connected with the "hot" electrical contact 120 in a conventional three-prong electrical connection system. Relay 122 may be controlled by microprocessor 140, as will be described below. Suitable relays 122 include, for example, electromechanical relays, solid state relays, or triac circuits. Other suitable relays 122 will be known to one of ordinary skill in the art from the description herein.

Light source 130 transmits light through socket 110. Desirably, light source 130 transmits light transversely through socket 110, i.e., in a direction substantially orthogonal to an axis of socket 110. Light source 130 may desirably be positioned next to the socket 110 corresponding to "neutral" electrical contact in a conventional three-prong electrical connection system (e.g., socket 110*c* in FIG. 2). In a conventional AC electrical connection system, the "hot" wire is at a high voltage relative to ground. The "neutral" wire is at the same voltage as ground, or close to the same voltage. Positioning the light source 130 next to the "neutral" socket may provide an additional safeguard. To get shocked, a user would have to put an implement (e.g., a screwdriver) in the neutral socket to such a manner as to fool the detection circuitry into energizing the receptacle while simultaneously putting something else (e.g., another screwdriver) in the "hot" socket. Accordingly, in this embodiment, a single misplaced implement may not both energize the receptacle and provide a high voltage connection.

Nonetheless, while only one light source 130 is illustrated, it will be understood by one of ordinary skill in the art that a light source 130 may be provided for each socket 110. In an exemplary embodiment, light source 130 is an infrared light-emitting diode (LED). Other suitable light sources 130 will be known to one of ordinary skill in the art from the description herein.

Light source 130 is positioned along the length of socket 110 based on the desired operation of electrical connection system 10. In one exemplary embodiment, light source 130 is positioned at an approximate midpoint along the length of socket 110, as shown in FIG. 2. In alternative exemplary embodiments, light source 130 is positioned at a first end 112 of socket 110 (i.e. adjacent the opening of socket 110) or at a second end 114 of socket 110 (i.e. adjacent contact 120). The position of light source 130 may control the operation of electrical connection system 10, as will be described below.

Photodetector 135 receives light from light source 130. Desirably, photodetector 135 is positioned to receive the light transmitted by light source 130 through socket 110. While only one photodetector 135 is illustrated, it will be understood by one of ordinary skill in the art that a photodetector 135 may be provided for each light source 130. In an exemplary embodiment, photodetector 135 is a phototransistor. Alternatively, photodetector 135 may be a photodiode. Other suitable photodetectors 135 will be known to one of ordinary skill in the art from the description herein.

Microprocessor 140 controls the operation of electrical connection system 10. Microprocessor 140 is programmed to selectively couple electrical contacts 120 with the power source based on the light from light source 130 received by photodetector 135. Where relay 122 is included in electrical connection system 10, microprocessor 140 may selectively couple contacts 120 with the power source by actuating relay 122.

As used herein, microprocessor 140 may include any electrical circuitry operable to achieve the functions described herein. One of ordinary skill in the art will recognize that microprocessor 140 may be a conventional microprocessor, a field programmable gate array (FPGA), an application specific integrated circuit (ASIC), or discrete logic elements. Microprocessor 140 may also include nonvolatile memory to maintain knowledge of the state of the receptacle (e.g., energized or de-energized) during power outages. Suitable microprocessors 140 will be known to one of ordinary skill in the art from the description herein.

Electrical receptacle system 100 may further include an independent power supply 145, as illustrated in FIG. 2. Independent power supply 145 supplies power to components of electrical receptacle system 100. For example, independent power supply 145 may supply power to light source 130, photodetector 135, microprocessor 140, and/or relay 122. Independent power supply 145 is illustrated as not coupled to the power source. However, it will be understood that independent power supply 145 may draw power from the power source. As such, independent power supply may be coupled or selectively coupled with the power source. In an exemplary embodiment, independent power supply 145 is a battery. Alternatively, independent power supply 145 may be a switching power supply connected to the power source. In this embodiment, independent power supply 145 may include a battery back-up. Other suitable independent power supplies 145 will be known to one of ordinary skill in the art from the description herein.

FIG. 3 illustrates electrical plug system 150 in accordance with aspects of the present invention. Electrical plug system 150 may be connected with an electrical appliance or device. Generally speaking, electrical plug system 150 includes prongs 160. Additional details of electrical plug system 150 are provided herein.

Prongs 160 are received by corresponding portions of an electrical receptacle. Each prong 160 is sized to be received in a respective socket 110 of electrical receptacle system 100. In the embodiment illustrated in FIG. 3, electrical plug system 150 includes three prongs 160. However, it will be understood by one of ordinary skill in the art that electrical plug system 150 may include more or fewer prongs 160 as is desired. In an exemplary embodiment, prongs 160 are electrical conductors (such as copper) sized and positioned to correspond to a conventional three-prong electrical plug. Suitable prongs 160 will be known to one of ordinary skill in the art from the description herein.

One or more prongs 160 include an opening 170. Desirably, opening 170 is a transverse opening, i.e., opening 170 is formed in a direction substantially orthogonal to an axis of prong 160. In the embodiment illustrated in FIG. 3, only one prong 160 (prong 160*c*) includes an opening 170. However, it will be understood by one of ordinary skill in the art that an opening 170 may be provided in each prong 160. In particular, it will be understood by one of ordinary skill in the art from the description herein that many conventional plugs include at least one prong having an opening. Thus, the system of the present invention may be used with conventional plugs, or may be used by modifying conventional plugs to include an opening.

Opening 170 is configured to allow light from light source 130 to pass through or by prong 160. In an exemplary embodiment, opening 170 is a through-hole formed in prong 160. Alternatively, opening may be a channel, notch, gap, or other structural feature, as would be understood by one of ordinary skill in the art from the description herein. Opening 170 may comprise open air, or may comprise a material of prong 160 that allows photons from light source 130 to pass through for receipt by photodetector 135.

Opening 170 is positioned along the length of prong 160 based on the desired operation of electrical connection system 10. In one exemplary embodiment, opening 170 is positioned at a first end 162 of prong 160 (i.e. adjacent the tip of prong 160), as shown in FIG. 3. This position may be particularly desirable in order for electrical connection system 10 to correspond to traditional two-prong or three-prong electrical plugs. In alternative exemplary embodiments, opening 170 is positioned at an approximate midpoint of prong 160 or at a second end 164 of prong 160 (i.e. adjacent the base of prong 160). The position of opening 170 may control the operation of electrical connection system 10, as will be described below.

The operation of electrical connection system 10 will now be generally described with reference to FIGS. 4A-5B. In order to generate an electrical connection using electrical connection system 10, a user inserts electrical plug system 150 into electrical receptacle system 100. During insertion, each prong 160 of electrical plug system 150 is received by a respective socket 110 of electrical receptacle system 100.

Figure 4A:
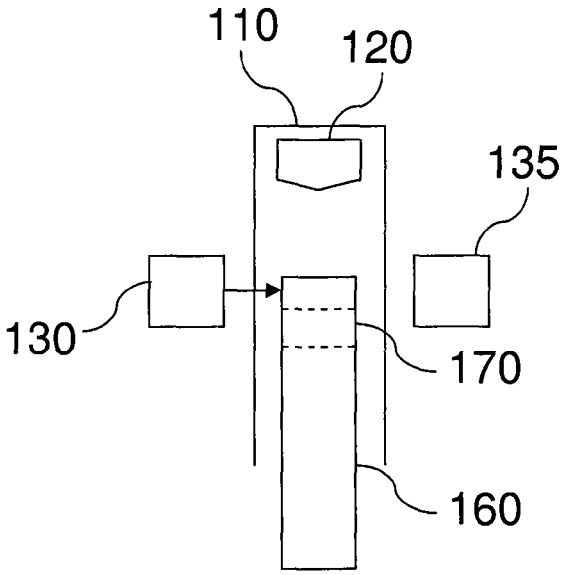
FIGS. 4A-4C are block diagrams illustrating an exemplary operation of the electrical connection system of FIG. 1.
Figure 4B:
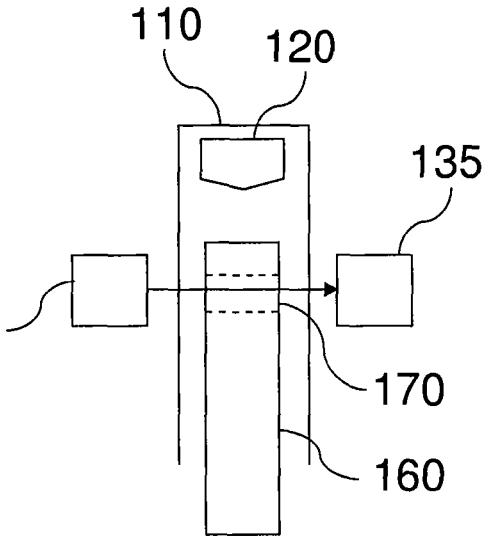
Figure 4C:
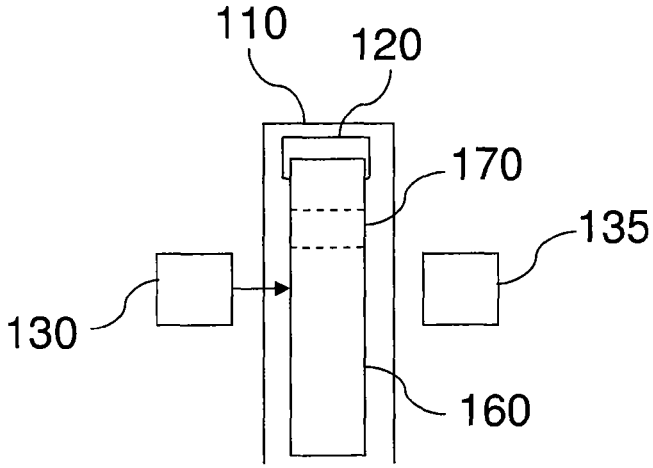

As described above, the position of light source 130 and opening 170 may affect the operation of electrical connection system 10. A first example of the operation of electrical connection system 10 is shown in FIGS. 4A-4C. This first example corresponds to an embodiment in which the light source 130 is positioned at an approximate midpoint along the length of socket 110, and where opening 170 is positioned at a first end 162 of prong 160 (i.e., adjacent the tip of prong 160).

At a first point during insertion of prong 160 (shown in FIG. 4A), the tip of prong 160 will pass the position of light source 130. When this happens, prong 160 will block the light transmitted by light source 130 (shown by arrow) from passing through socket 110. As a result, photodetector 135 will not receive the light from light source 130.

At a second point during insertion of prong 160 (shown in FIG. 4B), the opening 170 of prong 160 will pass the position of light source 130. When this happens, prong 160 will stop blocking the light transmitted by light source 130. At this point, light source 130 will transmit light through opening 170 and through socket 110. As a result, photodetector 135 will receive the light from light source 130.

At a third point during insertion of prong 160 (shown in FIG. 4C), the opening 170 of prong 160 will be beyond the position of light source 130, e.g., when prong 160 is fully inserted into socket 110. When this happens, prong 160 will once again block the light transmitted by light source 130 from passing through socket 110. As a result, photodetector 135 will not receive the light from light source 130.

Microprocessor 140 may use these three points to control when electrical contacts 120 are coupled with the power source (not shown). For example, when the light received by the photodetector completes a sequence of (1) not received, (2) received, (3) not received (corresponding to the first, second, and third points above), microprocessor 140 may determine that prongs 160 are fully inserted in sockets 110. Accordingly, microprocessor 140 may be programmed to couple electrical contacts 120 with the power source when the light received by the photodetector 135 completes the above sequence. Desirably, microprocessor 140 may require that the above sequence be completed within a predetermined period of time before coupling electrical contacts 120 with the power source (e.g., one second). If microprocessor 140 detects that the sequence was not completed within a predetermined period of time. or is completed in an incorrect order, microprocessor 140 may decouple electrical contacts 120 from the power source for a predetermined period of time, or until the sequence is correctly completed.

Additionally, when light is received by the photodetector, microprocessor 140 may determine that prongs 160 are not fully inserted in sockets 110. Accordingly, microprocessor 140 may be programmed to decouple electrical contacts 120 from the power source when light is received by photodetector 135.

As electrical plug system 150 is removed from electrical receptacle system 100, opening 170 will align with light source 130 and photodetector 135. Microprocessor 140 can de-energize electrical receptacle system 100 by decoupling electrical contacts 120 from the power source. In applications where an electrical arc should be avoided, electrical contacts 120 may be sized and positioned to maintain a connection with prongs 160 long enough to permit the microprocessor 140 to de-energize electrical receptacle system 100 before prongs 160 separates from the contacts 120. Thereby, prongs 160 may connect to electrical contacts 120 before microprocessor 140 couples electrical contacts 120 with the power source. Correspondingly, prongs 160 may disconnect from electrical contacts 120 after microprocessor 140 decouples electrical contacts 120 from the power source.

Where multiple sockets 110 include light sources 130 and photodetectors 135, and where multiple prongs 160 include openings 170, then microprocessor 140 may desirably require receiving the same signal from the multiple photodetectors 135 before microprocessor 140 couples electrical contacts 120 to the power source.

Figure 5A:
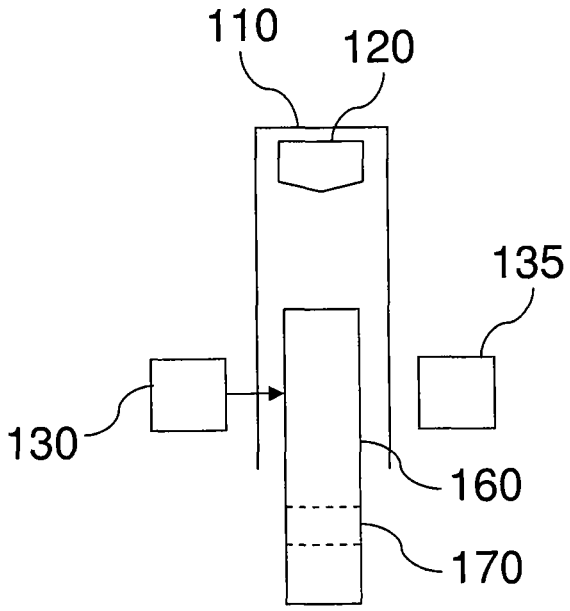
FIGS. 5A and 5B are block diagrams illustrating another exemplary operation of the electrical connection system of FIG. 1.
Figure 5B:
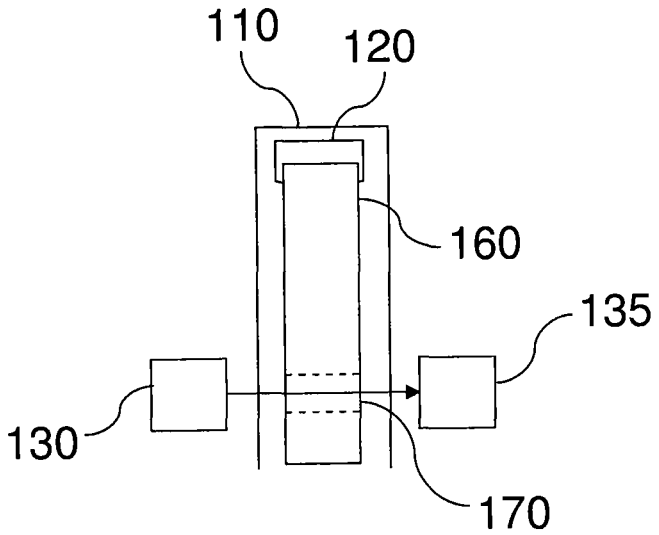

A second example of the operation of electrical connection system 10 is shown in FIGS. 5A and 5B. This second example corresponds to an embodiment in which the light source 130 is positioned at first end 112 of socket 110 (i.e. adjacent the opening of socket 110), and where opening 170 is positioned at a second end 164 of prong 160 (i.e., adjacent the base of prong 160).

At a first point during insertion of prong 160 (shown in FIG. 5A), the tip of prong 160 will pass the position of light source 130. When this happens, prong 160 will block the light transmitted by light source 130 (shown by arrow) from passing through socket 110. As a result, photodetector 135 will not receive the light from light source 130.

At a second point during insertion of prong 160 (shown in FIG. 5B), the opening 170 of prong 160 will be positions adjacent light source 130, i.e., when prong 160 is fully inserted into socket 110. When this happens, prong 160 will stop blocking the light transmitted by light source 130. At this point, light source 130 will transmit light through opening 170 and through socket 110. As a result, photodetector 135 will receive the light from light source 130.

Microprocessor 140 may use these two points to control when electrical contacts 120 are coupled with the power source (not shown). For example, when the light received by the photodetector completes a sequence of (1) not received, (2) received (corresponding to the first and second points above), microprocessor 140 may determine that prongs 160 are fully inserted in sockets 110. Accordingly, microprocessor 140 may be programmed to couple electrical contacts 120 with the power source when the light received by the photodetector completes the above sequence. Desirably, microprocessor 140 may require that the above sequence be completed within a predetermined period of time before coupling electrical contacts 120 with the power source.

Additionally, when light is not received by the photodetector, microprocessor 140 may determine that prongs 160 are not fully inserted in sockets 110. Accordingly, microprocessor 140 may be programmed to decouple electrical contacts 120 from the power source when light is not received by photodetector 135.

It will be understood by one of ordinary skill in the art that the operation of electrical connection system 10 is not limited to the above examples described with respect to FIGS. 4A-5B. To the contrary, many modes of operation will be recognizable to one of ordinary skill in the art in light of the above examples. The desired mode of operation may be selected based on the positioning of light source 130 along socket 110 and the positioning of opening 170 along prong 160. For example, microprocessor 140 may be programmed to only decouple the electrical contacts 120 from the power source when light is not received by the photodetector.

Figure 6:
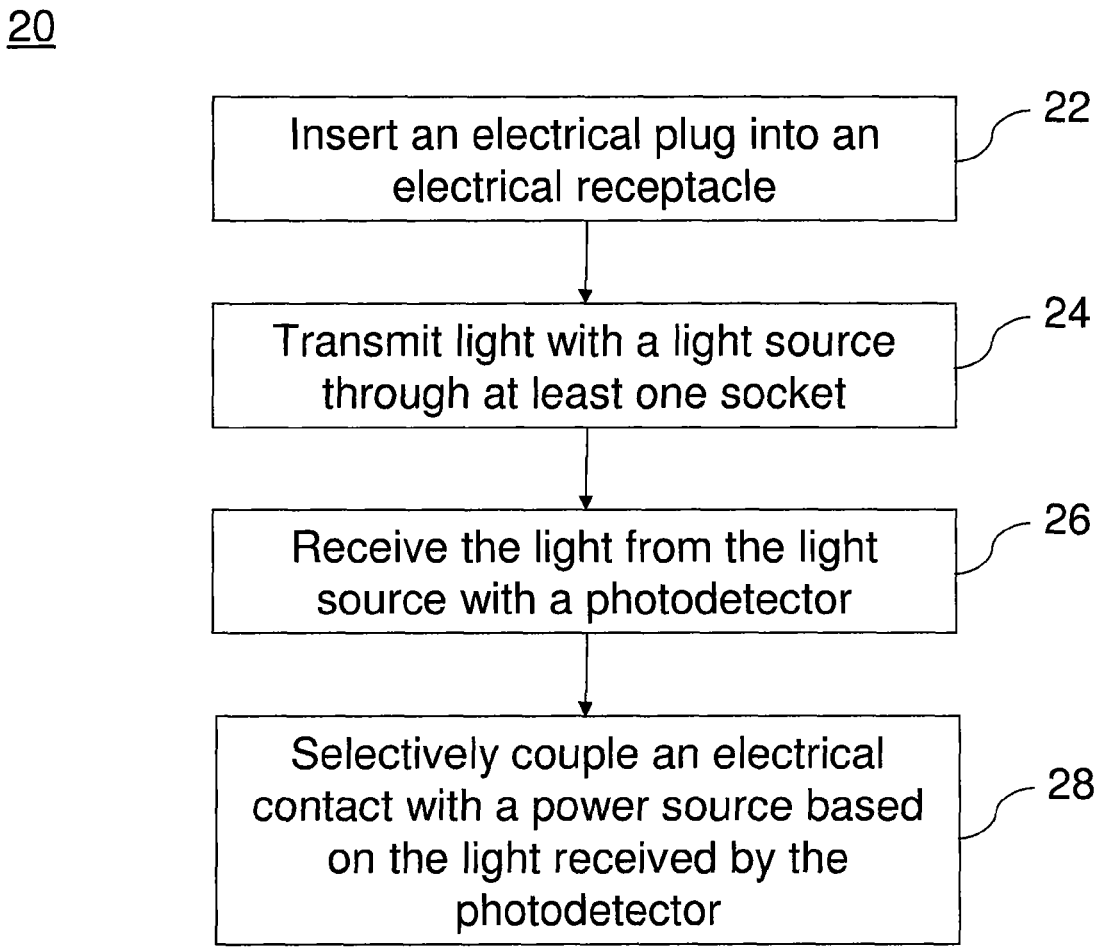
FIG. 6 is a flow chart illustrating an exemplary electrical connection method in accordance with aspects of the present invention.

FIG. 6 illustrates an exemplary electrical connection method 20 in accordance with aspects of the present invention. Electrical connection method 20 may be usable to provide electrical connections between a power supply and an electrical appliance or device. Generally, electrical connection method includes the steps of inserting an electrical plug, transmitting light with a light source, receiving light with a photodetector, and selectively coupling an electrical contact with a power source. Additional details of electrical connection method 20 are provided herein. For the purposes of illustration, the steps of electrical connection method 20 are described herein with reference to the exemplary electrical connection system 10 described above.

In step 22, an electrical plug is inserted into an electrical receptacle. In an exemplary embodiment, electrical plug system 150 is inserted into electrical receptacle system 100. During insertion, each prong 160 of electrical plug system 150 is received by a respective socket 110 of electrical receptacle system 100.

In step 24, light is transmitted with a light source through a socket. In an exemplary embodiment, light source 130 transmits light through socket 110. Desirably, light source 130 transmits light transversely through socket 110, i.e., in a direction substantially orthogonal to an axis of socket 110.

In step 26, light is received by a photodetector. In an exemplary embodiment, light from light source 130 is received by photodetector 135. Photodetector receives light passing through socket 110 and through opening 170 of prong 160.

In step 28, an electrical contact is selectively coupled with a power source based on the received light. In an exemplary embodiment, microprocessor 140 selectively coupled electrical contacts 120 with the power source based on the light received by photodetector 135. Microprocessor 140 may selectively couple electrical contacts 120 with the power source by actuating relay 122.

Step 28 may be performed based on the first example described above with respect to FIGS. 4A-4C. For example, microprocessor 140 may be programmed to couple electrical contacts 120 with the power source when the light received by the photodetector 135 completes the sequence of (1) not received, (2) received, (3) not received. Additionally, microprocessor 140 may be programmed to decouple electrical contacts 120 from the power source when light is received by photodetector 135. Other operations for coupling electrical contacts 120 with the power source based on the light received by photodetector 135 will be understood by one of ordinary skill in the art from the description herein.

The exemplary systems and methods described herein may provide advantages over conventional electrical connection systems as set forth below. In conventional electrical connection systems, electrical contacts are fixedly coupled to the power source. Thus, it is possible to create an electrical arc even when an electrical plug is not inserted in to the electrical receptacle. This may create a risk of electric shock when some other implement (e.g., a screwdriver) is inserted into the electrical receptacle.

To the contrary, the exemplary electrical connection systems and methods described herein may be designed to couple the electrical contacts to a power source only when an electrical plug (and not some other implement) is fully received within the electrical receptacle. This may create a safer electrical connection, and decrease or eliminate a risk of electric shock.

In the disclosed embodiments, the receptacle can be energized only after the prongs engage the contacts and de-energized before the prongs disengage from the contacts. In both cases, an electrical arc is avoided. Avoidance of electrical arcs is an important feature, as electrical arc may start fires or cause premature failure of the plug and receptacle. This may be especially important in a direct current power system.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An electrical receptacle system comprising:

a plurality of sockets sized to receive respective prongs from an electrical plug;

an electrical contact positioned within each of the plurality of sockets, at least one of the electrical contacts selectively coupled with a power source;

a light source positioned to transmit light through at least one of the sockets;

a photodetector positioned to receive the light transmitted by the light source through the at least one socket; and a microprocessor programmed to selectively couple the at least one electrical contact with the power source only after the light received by the photodetector completes a sequence of (1) not received, (2) received, (3) not received.

2. The electrical receptacle system of claim 1, wherein the light source is positioned at an approximate midpoint along a length of the at least one socket.

3. The electrical receptacle system of claim 2, wherein the light source is positioned to transmit light in a direction substantially orthogonal to an axis of the at least one socket.

4. The electrical receptacle system of claim 1, wherein the at least one electrical contact is positioned within a respective socket such that the respective prong connects to the at least one electrical contact before the microprocessor couples the at least one electrical contact with the power source.

5. The electrical receptacle system of claim 2, wherein the microprocessor is programmed to decouple the at least one electrical contact from the power source when the photodetector receives the light.

6. The electrical receptacle system of claim 5, wherein the at least one electrical contact is positioned within a respective socket such that the respective prong disconnects from the at least one electrical contact after the microprocessor decouples the at least one electrical contact from the power source.

7. The electrical receptacle system of claim 1, further comprising a relay controlled by the microprocessor for selectively coupling the at least one electrical contact with the power source.

8. The electrical receptacle system of claim 1, further comprising an independent power supply configured to supply power to the light source, the photodetector, and the microprocessor.

9. An electrical connection system comprising:

an electrical plug having a plurality of prongs, at least one of the prongs having at least one opening; and an electrical receptacle comprising:

a plurality of sockets sized to receive the plurality of prongs from the electrical plug;

an electrical contact positioned within each of the plurality of sockets, at least one of the electrical contacts selectively coupled with a power source;

a light source positioned to transmit light through at least one of the sockets, the at least one socket positioned to receive the at least one prong having the at least one opening;

a photodetector positioned to receive the light transmitted by the light source through the at least one socket and through the at least one opening formed in the at least one prong of the electrical plug; and a microprocessor programmed to selectively couple the at least one electrical contact with the power source only after the light received by the photodetector completes a sequence of (1) not received, (2) received, (3) not received.

10. The electrical connection system of claim 9, wherein the at least one opening is positioned at an end of the at least one prong, and the light source is positioned at an approximate midpoint along a length of the at least one socket.

11. The electrical connection system of claim 10, wherein the at least one opening is formed in a direction substantially orthogonal to an axis of the at least one prong, and the light source is positioned to transmit light in a direction substantially orthogonal to an axis of the at least one socket.

12. The electrical connection system of claim 10, wherein the microprocessor is programmed to decouple the at least one electrical contact from the power source when the photodetector receives the light.

13. The electrical connection system of claim 9, wherein the electrical receptacle further comprises a relay controlled by the microprocessor for selectively coupling the at least one electrical contact with the power source.

14. The electrical connection system of claim 9, wherein the electrical receptacle further comprises an independent power supply configured to supply power to the light source, the photodetector, and the microprocessor.

* * * * *